United States Patent [19]

Landecker

[11] Patent Number: 4,865,228

[45] Date of Patent: Sep. 12, 1989

[54] FLUID DISPENSER CAP HAVING FLUID COLLECTING DISH AND LOCKABLE PUMP ACTUATOR

[75] Inventor: David J. Landecker, Santa Barbara, Calif.

[73] Assignee: Menda Scientific Products, Inc., Santa Barbara, Calif.

[21] Appl. No.: 191,545

[22] Filed: May 9, 1988

[51] Int. Cl.[4] ..... B67B 5/00

[52] U.S. Cl. ..... 222/153; 222/205; 222/384; 222/402.11

[58] Field of Search ..... 222/153, 205, 402.11, 222/321, 384, 383, 402

[56] References Cited

U.S. PATENT DOCUMENTS

| | | | |
|---|---|---|---|
| 153,301 | 4/1949 | Menkin | D 58/8 |
| D. 292,675 | 11/1987 | Landecker | D 9/449 |
| 2,593,591 | 4/1952 | Menkin et al. | 222/205 |
| 3,185,355 | 5/1965 | Lipman | 222/341 |
| 3,263,871 | 8/1966 | Thompson | 222/205 |
| 3,797,705 | 3/1974 | Cooperider | 222/153 |
| 4,162,746 | 7/1979 | Anderson et al. | 222/153 |
| 4,343,417 | 8/1982 | Corsette | 222/153 |
| 4,757,922 | 7/1988 | Landecker | 222/205 |

*Primary Examiner*—Kevin P. Shaver
*Assistant Examiner*—Kenneth Noland
*Attorney, Agent, or Firm*—Marvin E. Jacobs

[57] ABSTRACT

A lockable fluid dispenser cap is used with a dispensing pump for dispensing a fluid product from a container. The dispenser cap includes a container closure, locking fingers mounted to the closure, a lock actuating member rotatably mounted to the closure, and a pump actuating member coupled to the lock actuating member. The closure mounts the pump in the container. The locking fingers are mounted to the closure and normally spaced in unlocking relation from the pump piston but are yieldably flexible for bending toward the piston. The lock actuating member has cam elements which upon rotation of the lock actuating member forcibly bend the fingers toward the piston and into a locking relation therewith. Reciprocal movement of the pump actuating member relative to the lock actuating member is used to actuate the piston. Also, rotational movement of the pump actuating member is used to cause rotation of the lock actuating member therewith for bending the fingers from their unlocking to locking relations. The pump actuating member includes a fluid collecting dish which receives fluid product from the pump when the locking fingers are in unlocking relation with the piston permitting reciprocal movement of the pump actuating member and the piston connected thereto toward and away from the cylinder for discharging fluid product from the piston to the collecting dish.

25 Claims, 2 Drawing Sheets

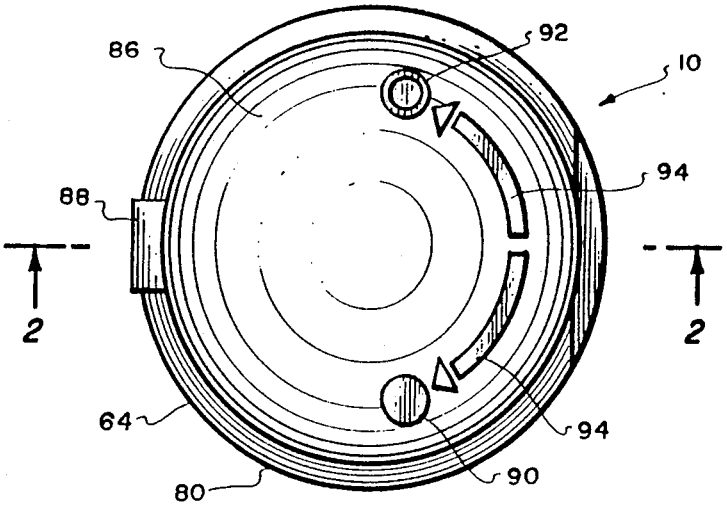
Fig. 1.
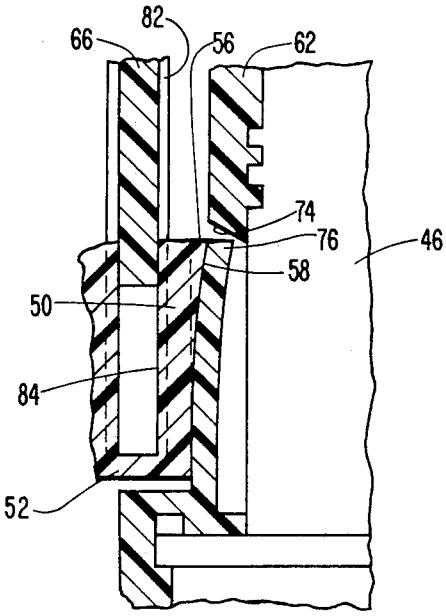
FIG. 2a.
Fig. 2
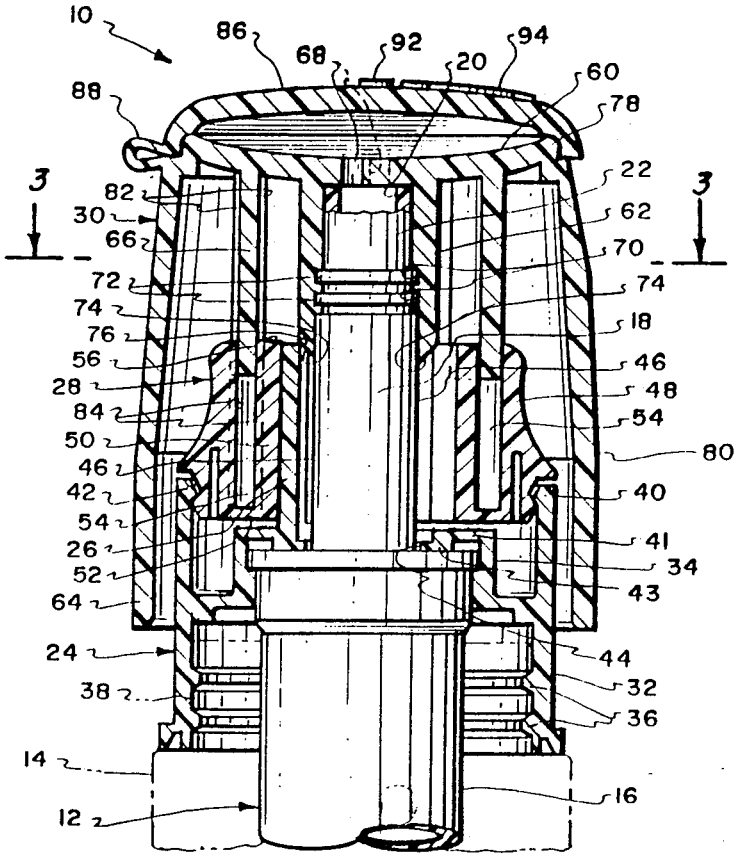

FLUID DISPENSER CAP HAVING FLUID COLLECTING DISH AND LOCKABLE PUMP ACTUATOR

BACKGROUND OF THE INVENTION

The present invention relates generally to dispensing apparatus and, more particularly, is concerned with a fluid dispenser cap having a fluid collecting dish integrally formed with a lockable pump actuator.

An automatic fluid dispenser cap having a top fluid collecting dish and being manually depressible to actuate a reciprocal pump for delivering fluid axially upward into the collecting dish has been commercially produced and sold by Menda Scientific Products, Inc. of Santa Barbara, Calif. for many years. U.S. Pat. No. 2,593,591 to Menkin et al and assigned to Menda Scientific Products, Inc., also the assignee of the present invention, discloses several embodiments representative of such fluid dispenser cap.

The Menda fluid dispenser cap has been used on containers holding a wide variety of different fluids, for example, alcohol, solvents and cosmetic liquids. It is designed for one-handed operation by eliminating the need to grasp the container and remove a cap or stopper before dispensing the fluid. By simply depressing the cap only as much fluid as is needed can be dispensed into the collecting dish or directly onto the applicator such as a cotton ball, cloth or brush. This eliminates loss to evaporation and spills.

The commercial acceptability of the above-described mode of operation makes adaptation of the Menda fluid dispenser cap to other uses highly desirable. One such use is in conjunction with retail consumer products wherein the container, fluid product and dispenser are typically assembled together and then shipped to retail stores. Thus, one important design consideration in adapting the Menda fluid dispenser cap for such use is to provide a way to prevent leakage of the product during shipment.

Fluid dispensers are known in the prior patent art which incorporate means for sealing and/or locking its pump mechanism to prevent leakage and evaporation of product during shipping, storage and periods of non-use. Some representative examples are the dispensers disclosed in U.S. Patents to Lipman (U.S. Pat. No. 3,185,355), Thompson (U.S. Pat. No. 3,263,871) and Anderson et al (U.S. Pat. No. 4,162,746) and a pump dispenser commercially produced by Calmar Industries. However, none of these prior art dispensers appear to have a construction readily compatible with the Menda-type fluid dispenser cap. Thus, a need exists for a way to adapt the Menda-type fluid dispenser cap for use with containers holding retail or consumer products to this prior art. Menda has chosen to adapt the Anderson/Calmar design to this purpose.

SUMMARY OF THE INVENTION

The present invention provides a lockable fluid dispenser cap designed to satisfy the aforementioned needs. The lockable fluid dispenser cap of the present invention advantageously has a fluid collecting dish integrally formed with a lockable fluid pump actuator. The marriage of these two components together provides a lockable fluid dispenser cap highly desirable for the following reasons. First, the product can now be protected effectively from leakage and evaporation during shipping, storage and periods of non-use. Second, the superior dispensing capability associated heretofore with the prior art Menda-type fluid dispenser of dispensing upon one-handed touch by the user without creating waste, dripping or spillage, can now be utilized by a wide variety of consumer product containers.

Accordingly, the present invention is directed to a lockable fluid dispenser cap for use with a fluid product dispensing pump. The dispensing pump has a cylinder and a piston mounted by the cylinder for reciprocal movement to draw a fluid product through the cylinder and piston and dispense the fluid product outwardly through a fluid discharge outlet in an outer end of the piston. The cap of the present invention comprises: (a) a container closure; (b) at least one locking finger mounted to the closure; (c) a lock actuating member rotatably mounted to the closure; and (d) a pump actuating member coupled to the lock actuating member.

More particularly, the closure is adapted for attachment through conventional screw threads to an upper end of a container which holds the fluid product and for mounting the pump at the cylinder thereof so as to support the pump in the container. Preferably, a plurality of locking fingers are mounted to the closure, extend along an outer portion of the piston, and are spaced circumferentially thereabout. The locking fingers are normally positioned in an outward radially spaced relation from the piston outer portion but are yieldably flexible for bending toward the piston outer portion.

Further, the lock actuating member rotatably mounted to the closure is disposed adjacent the locking fingers and has a plurality of cam elements which upon rotation of the lock actuating member in one direction move toward the locking fingers to forcibly bend the fingers toward the piston outer portion and into a locking relation therewith. On the other hand, rotation of the lock actuating member in an opposite direction moves the cam elements away from the locking fingers permitting them to return to their normal positions spaced from the piston outer portion and into an unlocking relation therewith.

Also, the pump actuating member is coupled to the lock actuating member for reciprocal movement which does not result in any movement of the lock actuating member and for rotational movement which causes rotation of the lock actuating member therewith. The pump actuating member includes an outer fluid collecting dish having at least on inlet hole defined therein in communication with the fluid discharge opening in the outer end of the piston but smaller in size than that of the piston outer end so as to preclude extension of the same therethrough. The pump actuating member also includes an inner hub adapted to receive and extend in attached relation over the upper end of the piston. The hub is movable inside the locking fingers when they are in unlocking relation with the piston thereby permitting reciprocal movement of the piston toward and away from the cylinder for discharging fluid product outwardly through the piston discharge opening to the outer dish upon reciprocal movement of the pump actuating member. On the other hand, the hub is engagable with the locking fingers and thus prevented from reciprocal movement therealong when they are in locking relation with the piston thereby preventing reciprocal movement of the pump actuating member and the piston therewith for dispensing fluid product to the outer dish.

The dispenser cap further includes a cover hingedly connected to the pump actuating member so as to overlie the outer fluid collecting dish. The cover is movable between opened and closed positions relative to the collecting dish.

Still further, the lock actuating member is a locking ring which includes an outer annular ring portion at which the ring is rotatably mounted to the closure, and an inner annular ring portion attached to the outer ring portion. The outer ring portion is located in outward radially spaced relation to the inner ring portion so as to define an annular channel therebetween. The inner ring portion surrounds the locking fingers and the piston outer portion and has the cam elements defined thereon such that rotation of the ring moves the inner ring portion and the cam elements therewith.

Furthermore, the inner hub of the pump actuating member is attached to and depends from an underside of the outer dish. The pump actuating member further includes an outer annular cover attached to and depending from dish underside so as to surround and extend past the container closure into overlapping and reciprocally movable relation with the upper end of the container when the piston is reciprocally moved relative to the cylinder. Still further, the pump actuating member includes an intermediate sleeve disposed between and spaced radially from the inner hub and outer cover. The intermediate sleeve extends into the locking ring channel and is coupled to the locking ring so as to permit reciprocal movement within the channel relative thereto but cause rotation of the locking ring upon rotational movement of the pump actuating member.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 1 is a top plan view of a lockable fluid dispenser cap constructed in accordance with the principles of the present invention.

FIG. 2 is a longitudinal axial sectional view of the dispenser cap taken along line 2——2 of FIG. 1, showing the dispenser cap in a locked condition.

FIG. 2A is an enlarged detailed view of the portion of the dispenser cap encircled by the dashed oval in FIG. 2 identified by the reference letter "B".

DETAILED DESCRIPTION OF THE INVENTION

Figure 3:
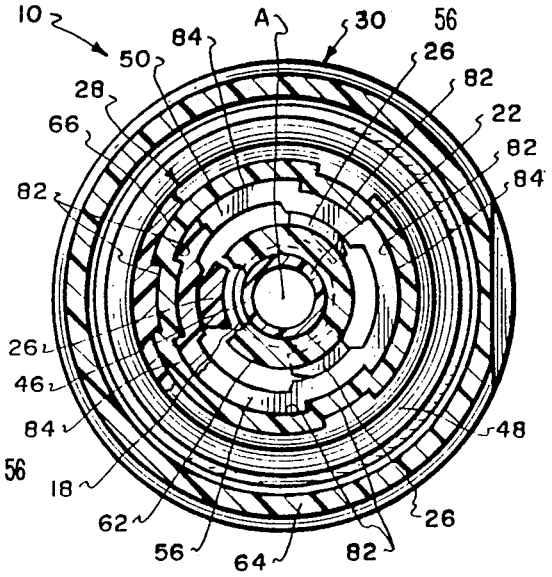
FIG. 3 is a cross-sectional view of the dispenser cap taken along line 3——3 of FIG. 2, showing the positions of a plurality of locking fingers of the dispenser cap when the dispenser cap is in its locked condition.

Referring now to the drawings, and particularly to FIGS. 1 to 3, there is shown a preferred embodiment of a lockable fluid dispenser cap, being indicated generally by the numeral 10 and constructed in accordance with the principles of the present invention. The lockable fluid dispenser cap 10 is adapted for use with a fluid product dispensing pump 12 on a container 14 which holds a fluid product. The dispensing pump 12 is conventional per se, and thus it is not necessary to illustrate or describe it in detail herein in order to understand the dispenser cap 10 of the present invention. Suffice it to say that the pump 12 has a hollow cylinder 16 and a hollow piston 18 mounted by the cylinder 16 for vertical reciprocal movement along the longitudinal axis of the cylinder 16. Upon reciprocal movement through a complete stroke, first downward and then upward relative to the cylinder 16, the piston 18 is operable to draw fluid product from the container 14 upwardly through the cylinder 16 and itself and cause dispensing of the fluid product outwardly through a fluid discharge outlet 20 in an outer end 22 of the piston 18.

The lockable fluid dispenser cap 10 of the present invention basically includes a container closure 24, at least one and, preferably, a plurality of locking fingers 26 mounted to the closure 24, a lock actuating member 28 rotatably mounted to the closure 24, and a pump actuating member 30 coupled to the lock actuating member 28.

More particularly, the closure 24 of the dispenser cap 10 has an outer tubular portion 32 and an inner annular rim portion 34. The closure outer tubular portion 32 has lower internal threads 36 threadable with external threads 38 about the top of the container 14 to attach the dispenser cap 10 to the container 14. Further, the closure outer tubular portion 32 has an internal annular bead 40 at its upper edge which is received in an external annular recess 42 formed in the lock actuating member 28 to rotatably mount the lock actuating member 28 within the outer tubular portion 32 of the closure 24. The closure inner rim portion 34 has a step-like configuration in axial section defining an internal recess 41 adapted to receive a top ledge 43 on the upper end of the pump cylinder 16 for supporting the pump 12 at its cylinder 16 in the container.

Figure 5:
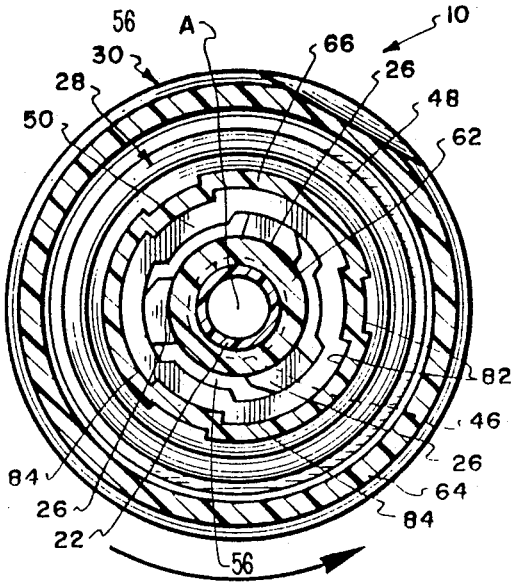
FIG. 5 is a cross-sectional view of the dispenser cap taken along line 5—5 of FIG. 4, showing the positions of locking fingers of the dispenser cap when the dispenser cap is in its unlocked condition.
Figure 4:
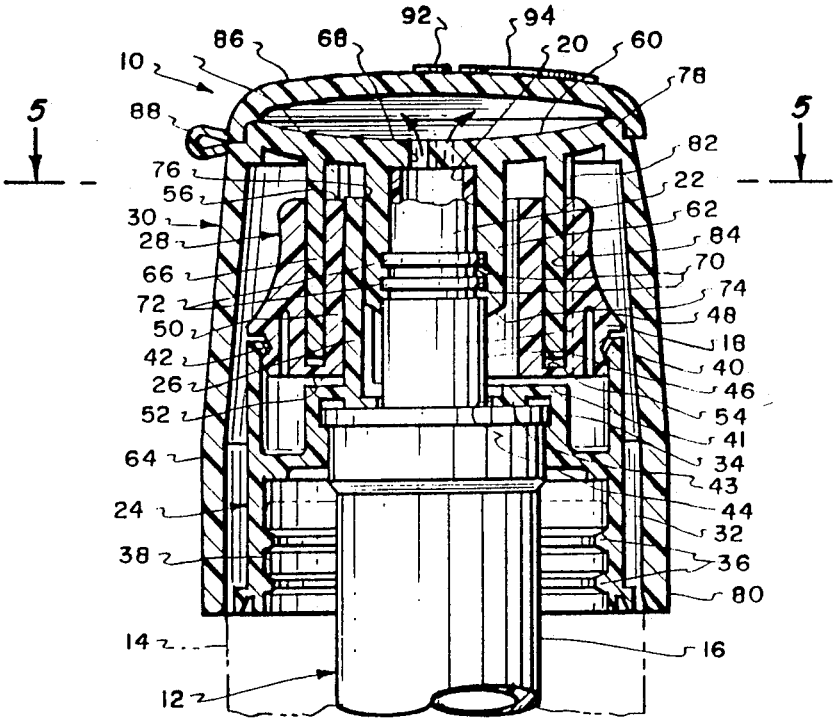
FIG. 4 is a longitudinal axial sectional view of the dispenser cap similar to that of FIG. 2, but showing the dispenser cap in an unlocked condition with the plunger in depressed position.

The locking fingers 26 of the dispenser cap 10, for instance being three in number, are mounted upright on the inner rim portion 34 of the closure 24. The fingers 26 are spaced circumferentially from one another about the periphery of a central opening 44 in the inner rim portion 34 of the closure 24 through which extends the cylindrical outer portion 46 of the reciprocal pump piston 18. The fingers 26 extend in upstanding fashion along the piston outer portion 46 and, as seen in FIGS. 4 and 5, are normally positioned in an outward radially spaced relation from the piston outer portion 46. However, the locking fingers 26, preferably fabricated by a suitable molding process of a suitable resilient plastic material, such as polypropylene, as part of a one-piece unit with the closure 24, are yieldably flexible making them capable of bending toward the piston outer portion 46.

As mentioned previously, the lock actuating member 28 of the dispenser cap 10 being in the form of a locking ring is rotatably mounted to the closure 24. The locking ring 28 includes an outer annular ring portion 48 and an inner annular ring portion 50. The outer ring portion 48 has the external annular recess 42 by which the locking ring 28 is rotatably mounted to the internal annular bead 40 of the closure 24. The inner ring portion 50 is attached to the outer ring portion 48 at the respective lower exterior and interior peripheries thereof by an annular flat web portion 52. The outer ring portion 48 is thus located in outward radially spaced relation to the inner ring portion 50 so as to define an annular gap or channel 54 therebetween being open at its top and the bottom of which is defined by the web portion 52 of the locking ring 28. Preferably, the outer and inner ring portions 48, 50 and the bottom web portion 52 of the locking ring 28 are fabricated as a onepiece unit by a suitable molding process of a suitable plastic material, such as polypropylene.

The inner ring portion 50 is disposed adjacent to and surrounds the upstanding and angularly displaced locking fingers 26 and the piston outer portion 46. The inner ring portion 50 has cam elements 56 defined on the upper extent thereof which project radially inward toward the piston outer portion 46 and are radially displaced from a central axis A of the dispensing cap 10 through the same distance as the locking fingers 26. The cam elements 56 are the same in number as the locking fingers 26, such being three as seen in FIGS. 3 and 5.

The locking fingers 26 are forced into a locking relation with the pump piston outer portion 46 upon rotation of the locking ring 28 in one direction and are permitted to return to an unlocking relation with the pump piston outer portion 46 upon rotation of the locking ring 28 in an opposite direction. Specifically, upon rotation of the locking ring 28 in the counterclockwise direction, from the position seen in FIG. 5 to the position seen in FIG. 3, the cam elements 56 are move along a circular path toward the locking fingers 26 and forcibly engage the fingers 26 at their leading longitudinally bevelled or tapered surfaces 58 and cause slight inwardly-directed bending of the fingers 26 at their upper portions, as depicted in FIG. 2, toward the piston outer portion 46 and into the locking relation therewith as seen in FIGS. 2 and 3. On the other hand, upon rotation of the locking ring 28 in the opposite clockwise direction, from the position seen in FIG. 3 to the position seen in FIG. 5, the cam elements 56 are moved away from the locking fingers 26 permitting them to resiliently return to their normal positions spaced from the piston outer portion 46 and into the unlocking relation therewith as seen in FIGS. 4 and 5.

The pump actuating member 30 of the dispenser cup 10 is coupled to the locking ring 28 both for reciprocal movement relative thereto which does not result in any movement of the locking ring 28 and for rotational movement which, in turn, rotatably carries the locking ring 28 with it. Basically, the pump actuating member 30 includes an outer fluid collecting dish 60, an inner annular hub 62, an outer annular cover 64, and an intermediate annular sleeve 66.

More particularly, the outer collecting dish 60 of the pump actuating member 30 has an overall concave shape adapting it to hold a small quantity of the fluid product therein. The outer dish 60 has several inlet holes or orifices 68 defined in the center thereof which communicate with the fluid discharge outlet or opening 20 in the outer end 22 of the pump piston 18 for receiving the fluid product therefrom. However, each of the orifices 68 is smaller in diameter of the outside of the piston outer end 22 so as to preclude extension of the latter through the orifices 68.

The inner annular hub 62 of the pump actuating member 30 is attached to and depends from the underside of the outer dish 60. The hub 62 is of an interior diameter size adapting it to receive and extend over the outer end 22 of the piston 18. The hub 62 and piston outer end 22 have respective complementarily-configured annular recesses 70 and ribs 72 thereon for attaching the hub 62 to the piston outer end 22.

The hub 62 is movable along the locking fingers 26, if the fingers 26 are in their outwardly spaced unlocking relation with the piston 18 as seen in FIGS. 4 and 5, by moving the pump actuating member 30 through a complete reciprocatory stroke. The pump actuating member 30 is shown at the outward beginning and ending positions of the stroke in FIG. 2 and inward intermediate position of the stroke in FIG. 4. Such movement of the pump actuating member 30 causes reciprocal movement of the piston outer portion 46 toward and away from the pump cylinder 16 for discharging fluid product outwardly through the piston discharge opening 20 and inlet orifices 68 of the outer dish 60 onto the upper side of the outer dish. On the other hand, the inner end 74 of the inner hub 62 is engagable with the outer tips 76 of the locking fingers 26 and thus the hub is prevented from reciprocal movement therealong if the fingers 26 are in locking relation with the piston 18 as seen in FIGS. 2 and 3. The pump actuating member 30 and piston 18 therewith are thereby prevented from undergoing reciprocal movement for dispensing fluid product to the outer dish 60.

The outer annular cover 64 of the pump actuating member 30 is attached to and depends from the underside of a peripheral rim 78 of the collecting dish 60 so as to surround and extend past the container closure 24 into an overlapping and reciprocally movable relation with the upper end of the container 14. The outer surface 80 of the outer cover 64 can be manually gripped by a user's fingers in order to rotate the pump actuating member 30 to, in turn, rotate the locking ring 28 to position the locking fingers 26 in the desired locking or unlocking relation with the piston outer portion 46 and the inner hub 62 of the pump actuating member 30.

The intermediate annular sleeve 66 of the pump actuating member 30 is likewise attached to the underside of the outer collecting dish 60 of the pump actuating member 30. The intermediate sleeve 66 is disposed between and spaced radially from the inner hub 62 and outer cover 64. The intermediate sleeve 66 extends into the locking ring open-topped annular channel 54 and is coupled to the locking ring 28 so as to permit reciprocal movement within the channel 54 relative thereto but cause rotation of the locking ring 28 upon rotational movement of the pump actuating member 30. As can be best seen in FIGS. 3 and 5, complementarily-shaped intermeshing longitudinal grooves 82 and ribs 84 are formed respectively in the opposite sides of the intermediate sleeve 66 and on the facing surfaces of the outer and inner ring portions 48, 50 defining the annular channel 54 therebetween. It is these intermeshing grooves and ribs 82, 84 which allow reciprocal movement of the pump actuating member 30 relative to the locking ring 28 but require rotational movement of the locking ring 28 with the pump actuating member 30.

Finally, the dispenser cap 10 includes a circular cover 86 connected by a hinge 88 to the peripheral rim 78 of the outer collecting dish 60 of the pump actuating member 30 so as to overlie and sealably close the outer dish 60. The inner periphery of the cover 86 is sized and shaped with respect to the peripheral rim 78 of the outer dish 60 to make a snap fit therewith. The hinge 88 allows the cover 86 to be movable between opened and closed positions relative to the collecting dish 60 while maintaining attachment thereto. As seen in FIG. 1, a solid circle 90, an open circle 92 and an arrow 94 extending therebetween are formed in a raised configuration on the upper side of the cover 86 to indicate to a user the directions in which to rotate the pump actuating member 30 for locking and unlocking the member 30. The cover 86, the hinge 88 and the respective parts of the plug actuating member 30 are fabricated as a one-piece unit by a suitable molding process of a suitable plastic material, such as polypropylene. Many other suitable cap structures can be utilized.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A lockable fluid dispenser cap for use with a fluid product dispensing pump having a cylinder and a piston mounted by the cylinder for reciprocal movement to draw a fluid product through the cylinder and piston and dispense the fluid product outwardly through a fluid discharge outlet in an outer end of the piston, said lockable dispenser cap comprising:

(a) a container closure adapted for attachment to an upper end of a container holding the fluid product and for mounting the pump at the cylinder thereof so as to support the pump in the container;

(b) at least one locking finger mounted to said closure and adapted to extend along an outer portion of the piston when the pump is mounted to said closure, said locking finger normally positioned in an outward radially spaced relation from the piston but being yieldably flexible for bending toward the piston;

(c) a lock actuating member rotatably mounted to said closure and disposed adjacent said locking finger, said lock actuating member having at least one cam element which upon rotation of said lock actuating member in one direction moves toward said locking finger to forcibly bend said finger toward the piston and into a locking relation therewith whereas upon rotation of said lock actuating member in an opposite direction said cam element moves away from said locking finger permitting said finger to return to its normal position spaced from the piston and into an unlocking relation therewith;

(d) a pump actuating member connected to the piston and coupled to said lock actuating member for rotational movement to cause rotation of said lock actuating member therewith for positioning said locking finger in its respective locking and unlocking relations with the piston, said pump actuating member also coupled to said lock actuating member so as to be capable of reciprocal movement relative thereto for causing dispensing of fluid product from the piston when said locking finger is in its unlocking relation with the piston but incapable of reciprocal movement when said locking finger is in its locking relation with the piston; and (e) said pump actuating member including an outer fluid collecting dish having at least one inlet hole defined therein in communication with the fluid discharge opening in the outer end of the piston for dispensing of fluid product from the piston onto said outer collecting dish.

2. The discharge cap of claim wherein said hole defined in said outer collecting dish is smaller in size than the discharge opening in the piston outer end so as to preclude extension of the same therethrough.

3. The discharge cap of claim 1 wherein said pump actuating member also includes an inner hub adapted to receive and extend in attached relation over the upper end of the piston, said hub upon reciprocal movement of said pump actuating member being movable along said locking finger when said locking finger is in unlocking relation with the piston thereby permitting reciprocal movement of the piston toward and away from the cylinder for discharging fluid product outwardly through the piston discharge opening to said outer dish, said hub being engagable with said locking finger and thus prevented from movement therealong when said locking finger is in locking relation with the piston thereby preventing reciprocal movement of said pump actuating member and the piston therewith for dispensing fluid product to said outer dish.

4. The dispenser cap of claim 1 further comprising:

a cover hingedly connected to said pump actuating member so as to overlie said outer fluid collecting dish and being movable between opened and closed positions relative thereto.

5. The dispenser cap of claim 1 wherein a plurality of locking fingers are mounted to said closure and spaced circumferentially about the piston when the pump is mounted to said closure.

6. The dispenser cap of claim 1 wherein said lock actuating member is a locking ring including an outer annular ring portion at which said locking ring is rotatably mounted to said closure.

7. The dispenser cap of claim 6 wherein said locking ring also includes an inner annular ring portion attached to said outer ring portion, said outer ring portion being located in outward radially spaced relation to said inner ring portion so as to define an annular channel therebetween.

8. The dispenser cap of claim 7 wherein said inner ring portion surrounds said locking finger and the piston outer portion and has said inner cam element defined thereon such that rotation of said ring moves said inner ring portion and said cam element therewith.

9. The dispenser cap of claim 3 wherein said inner hub of said pump actuating member is attached to and depends from an underside of said outer dish.

10. The dispenser cap of claim 9 wherein said pump actuating member further includes an outer annular cover attached to and depending from an underside of said outer dish so as to surround and extend past said container closure into overlapping and reciprocally movable relation with the upper end of the container when the piston is reciprocally moved relative to the cylinder.

11. The dispenser cap of claim 10 wherein said pump actuating member still further includes an intermediate sleeve being disposed between and spaced radially from said inner hub and outer cover, said intermediate sleeve being coupled to said lock actuating member so as to permit said reciprocal movement relative thereto but cause said rotation of said lock actuating member upon rotational movement of said pump actuating member.

12. The dispenser cap of claim 11 wherein said lock actuating member is a locking ring including an outer annular ring portion at which said ring is rotatably mounted to said closure.

13. The dispenser cap of claim 12 wherein said locking ring also includes an inner annular ring portion attached to said outer ring portion, said outer ring portion being located in outward radially spaced relation to said inner ring portion so as to define an annular channel in which said intermediate sleeve of said pump actuating member is mounted for coupling said pump actuating member to said lock actuating member.

14. The dispenser cap of claim 13 wherein a plurality of said locking fingers are mounted to said closure and spaced circumferentially about the piston when the pump is mounted to said closure.

15. The dispenser cap of claim 14 wherein said inner ring portion surrounds said locking fingers and the piston outer portion and has a plurality said inner cam elements defined thereon such that rotation of said ring moves said inner ring portion and said cam elements therewith.

16. A lockable fluid dispenser for use on a container holding a fluid product, said dispenser comprising:

(a) a fluid product dispensing pump having a cylinder and a piston mounted by said cylinder for reciprocal movement to draw a fluid product through said cylinder and piston and dispense the fluid product outwardly through a fluid discharge outlet in an outer end of said piston; and (b) a lockable dispenser cap adapted to support said pump in the container, said dispenser cap including (i) a container closure adapted for attachment to an upper end of the container and for mounting said pump at said cylinder thereof so as to support said pump in the container, (ii) a plurality of locking fingers mounted to said closure, adapted to extend along an outer portion of said piston and spaced circumferentially about said piston, said locking fingers normally positioned in an outward radially spaced relation from said piston but being yieldably flexible for bending toward said piston, (iii) a lock actuating member rotatably mounted to said closure and disposed adjacent said locking fingers, said lock actuating member having a plurality of cam elements which upon rotation of said lock actuating member in one direction move toward said locking fingers to forcibly bend said fingers toward said piston and into a locking relation therewith whereas upon rotation of said lock actuating member in an opposite direction said cam elements move away from said locking fingers permitting said fingers to return to their normal positions spaced from said piston and into an unlocking relation therewith, and (iv) a pump actuating member connected to said piston and coupled to said lock actuating member for rotational movement to cause rotation of said lock actuating member therewith for positioning said locking fingers in respective locking and unlocking relations with said piston, said pump actuating member also coupled to said lock actuating member so as to be capable of reciprocal movement relative thereto for causing dispensing of fluid product from said piston when said locking fingers are in unlocking relation with said piston but incapable of reciprocal movement when said locking fingers are in locking relation with said piston, (v) said pump actuating member including an outer fluid collecting dish having at least one inlet hole defined therein in communication with the fluid discharge opening in the outer end of said piston for dispensing of fluid product from the piston onto said outer collecting dish.

17. The discharge cap of claim 16 wherein said hole defined in said outer collecting dish is smaller in size than the discharge opening in the piston outer end so as to preclude extension of the same therethrough.

18. The fluid dispenser of claim 16 further comprising:

a cover hingedly connected to said pump actuating member so as to overlie said outer fluid collecting dish and being movable between opened and closed positions relative thereto.

19. The fluid dispenser of claim 16 wherein said lock actuating member is a locking ring including an outer annular ring portion at which said ring is rotatably mounted to said closure.

20. The fluid dispenser of claim 19 wherein said locking ring also includes an inner annular ring portion attached to said outer ring portion, said outer ring portion being located in outward radially spaced relation to said inner ring portion so as to define an annular channel therebetween.

21. The fluid dispenser of claim 20 wherein said inner ring portion surrounds said locking fingers and the piston outer portion and has said cam elements defined thereon such that rotation of said ring moves said inner ring portion and said cam elements therewith.

22. The fluid dispenser of claim 16 wherein said pump actuating member also includes an inner hub adapted to receive and extend in attached relation over said upper end of said piston, said hub upon reciprocal movement of said pump actuating member being movable along said locking fingers when said fingers are in unlocking relation with said piston thereby permitting reciprocal movement of said piston toward and away from said cylinder for discharging fluid product outwardly through said piston discharge opening to said outer dish, said hub being engagable with said locking fingers and thus prevented from movement therealong when said fingers are in locking relation with said piston thereby preventing reciprocal movement of said pump actuating member and said piston therewith for dispensing fluid product to said outer dish.

23. The fluid dispenser of claim 22 wherein said inner hub of said pump actuating member is attached to and depends from an underside of said outer dish.

24. The dispenser cap of claim 22 wherein said pump actuating member further includes an outer annular cover attached to and depending from said underside of said outer dish so as to surround and extend past said container closure into overlapping and reciprocally movable relation with said upper end of the container when said piston is reciprocally moved relative to said cylinder.

25. The dispenser cap of claim 24 wherein said pump actuating member still further includes an intermediate sleeve being disposed between and spaced radially from said inner hub and outer cover, said intermediate sleeve being coupled to said lock actuating member so as to permit said reciprocal movement relative thereto but cause said rotation of said lock actuating member upon rotational movement of said pump actuating member.

* * * * *